US012553303B2

(12) United States Patent
Aldossary et al.

(10) Patent No.: US 12,553,303 B2
(45) Date of Patent: Feb. 17, 2026

(54) EXPANDABLE PACKER SYSTEMS AND METHODS

(71) Applicant: SAUDI ARABIAN OIL COMPANY, Dhahran (SA)

(72) Inventors: Abdulla Faleh Aldossary, Dhahran (SA); Olalekan Akiode, Dammam (SA); Ossama Sehsah, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/790,244

(22) Filed: Jul. 31, 2024

(65) Prior Publication Data

US 2026/0036008 A1 Feb. 5, 2026

(51) Int. Cl.
*E21B 23/06* (2006.01)
*E21B 33/127* (2006.01)

(52) U.S. Cl.
CPC ..... *E21B 23/065* (2013.01); *E21B 33/127* (2013.01)

(58) Field of Classification Search
CPC ..... E21B 7/20; E21B 23/0414; E21B 23/065; E21B 33/124; E21B 33/127; E21B 33/1275; E21B 33/1285
See application file for complete search history.

(56) References Cited

U.S. PATENT DOCUMENTS 2,519,116 A * 8/1950 Crake ..... E21B 33/1212 166/187
2,656,891 A * 10/1953 Toelke ..... E21B 33/127 166/187
2,671,510 A * 3/1954 Slick ..... E21B 33/127 277/331
3,086,589 A * 4/1963 McGowen, Jr. ..... E21B 33/12 166/134
RE25,846 E * 8/1965 Campbell ..... E21B 33/1295 166/122
3,357,504 A * 12/1967 Calhoun ..... E21B 49/088 166/147

(Continued)

FOREIGN PATENT DOCUMENTS

CA 2497269 A1 3/2004
CN 109281635 A * 1/2019 ..... E21B 33/127

(Continued)

*Primary Examiner* — Jennifer H Gay
(74) *Attorney, Agent, or Firm* — Osha Bergman Watanabe & Burton LLP

(57) ABSTRACT

A packer system includes an expandable packer disposed on a casing. The expandable packer is formed from a metal, includes one or more expandable wall portions that expand in response to a threshold pressure that is greater than a predetermined maximum drilling pressure, and includes an ignition component that sparks a chemical powder to cause the one or more expandable wall portions to expand. A method includes disposing first and second expandable packers on a casing. One or more first expandable wall portions of the first expandable packer are urged to expand in response to a first threshold pressure. If the one or more first expandable wall portions do not expand, then one or more second expandable wall portions of the second expandable packer are caused to expand in response to a higher, second threshold pressure, via actuating an ignition component that sparks a chemical powder.

17 Claims, 6 Drawing Sheets

(56) References Cited

U.S. PATENT DOCUMENTS 3,762,470 A * 10/1973 Eggleston ..... E21B 33/1275 166/182
4,840,231 A * 6/1989 Berzin ..... E21B 23/065 166/387
4,871,024 A * 10/1989 Cizek ..... E21B 41/02 507/269
5,322,019 A 6/1994 Hyland
5,400,855 A * 3/1995 Stepp ..... E21B 33/127 166/151
7,051,805 B2 * 5/2006 Doane ..... E21B 23/0416 166/134
7,743,831 B2 * 6/2010 Bunnell ..... E21B 23/00 166/57
8,726,996 B2 * 5/2014 Busaidy ..... E21B 33/1285 175/4.54
9,359,860 B2 * 6/2016 Hallundbæk ..... E21B 23/06
9,708,862 B2 * 7/2017 Hallundbæk ..... E21B 17/00
10,280,704 B2 * 5/2019 Vasques ..... E21B 33/1208
10,344,555 B2 * 7/2019 Massey ..... E21B 33/127
10,711,562 B2 * 7/2020 Stæhr ..... E21B 33/1208
10,927,627 B2 2/2021 Eitschberger et al.
11,401,761 B2 8/2022 Flores Perez et al.
11,788,365 B2 * 10/2023 Roselier ..... E21B 34/063 166/369
12,188,316 B2 * 1/2025 Tonti ..... E21B 23/065
2003/0141079 A1 * 7/2003 Doane ..... E21B 23/0416 166/134
2007/0175665 A1 * 8/2007 Tessari ..... E21B 10/66 175/171
2009/0205833 A1 * 8/2009 Bunnell ..... E21B 34/066 166/57
2011/0132608 A1 * 6/2011 Busaidy ..... E21B 33/1285 166/297
2013/0186615 A1 * 7/2013 Hallunb ..... E21B 23/06 166/120
2014/0190708 A1 * 7/2014 Hallundbaek ..... E21B 33/1277 166/207
2015/0275066 A1 * 10/2015 Martin ..... E21B 33/127 507/202
2016/0222753 A1 * 8/2016 Massey ..... E21B 23/065
2016/0273298 A1 * 9/2016 Vasques ..... E21B 33/127
2017/0101847 A1 * 4/2017 Hazel ..... E21B 33/13
2020/0308946 A1 * 10/2020 Freeman ..... E21B 33/124
2021/0140255 A1 * 5/2021 Greci ..... E21B 23/065
2022/0090455 A1 * 3/2022 Roselier ..... E21B 23/04
2022/0195832 A1 * 6/2022 Hallundbæk ..... E21B 33/127
2023/0349252 A1 * 11/2023 Tonti ..... E21B 23/065

FOREIGN PATENT DOCUMENTS

CN 111502625 A 8/2020
CN 114517653 A * 5/2022 ..... E21B 23/065
FR 3151872 A1 * 2/2025 ..... E21B 33/1216
GB 2320734 A * 7/1998 ..... E21B 33/1277
WO WO-2015117924 A2 * 8/2015 ..... E21B 23/065
WO WO-2020139459 A2 * 7/2020

* cited by examiner

EXPANDABLE PACKER SYSTEMS AND METHODS

BACKGROUND

In the hydrocarbon recovery arts, unique challenges are often encountered that are tied to characteristics of the formations in which drilling and recovery takes place. For instance, in some geographical regions, different formation layers including of carbonate, sand and shale may be encountered in top- and mid-hole sections of a wellbore being drilled. Carbonate formation layers, which may be in the form of limestone or chalk, may often include irregularities such as fractures, cracks or cavities. Thus, unmodified conventional drilling techniques may often lead to lost circulation (of drilling fluid or hydrocarbons alike), obstructions in the wellbore from formation instability, stuck drilling tools and lost-in-hole (LIH) incidents, and difficulties in subsequently setting a casing in the wellbore. Large expenditures of time and resources may then be necessary for curing related hydrocarbon losses or structural fixes or retrofits. Related problems and expenditures may also be compounded if directional drilling (e.g., lateral or horizontal) is involved.

Conventional remedial measures, including the use of lost circulation material (LCM) or cement plugs to inhibit or arrest fluid loss, are often not fully effective. Related challenges are particularly acute in the context of a "casing-while-drilling" (CWD) system, and at least in related processes of cementing a casing, such as a production casing, within a wellbore.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

In one aspect, embodiments disclosed herein relate to a packer system that includes an expandable packer disposed on a casing. The expandable packer is formed from a metal, includes one or more expandable wall portions that expand in response to a threshold pressure that is greater than a predetermined maximum drilling pressure, and includes an ignition component that sparks a chemical powder to cause the one or more expandable wall portions to expand.

In one aspect, embodiments disclosed herein relate to a method that includes disposing a first expandable packer on a casing, the first expandable packer being formed from a metal, and disposing a second expandable packer on the casing at an axially spaced-apart position with respect to the first expandable packer, the second expandable packer being formed from a metal. One or more first expandable wall portions of the first expandable packer are urged to expand in response to a first threshold pressure within the casing. If the one or more first expandable wall portions do not expand in response to the first threshold pressure, then one or more second expandable wall portions of the second expandable packer are caused to expand in response to a second threshold pressure within the casing that is higher than the first threshold pressure. Causing the one or more second expandable wall portions to expand includes prompting an increase in pressure within the casing from the first threshold pressure to the second threshold pressure and actuating an ignition component that sparks a chemical powder.

Other aspects and advantages of the claimed subject matter will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency.

DETAILED DESCRIPTION

Figure 1:
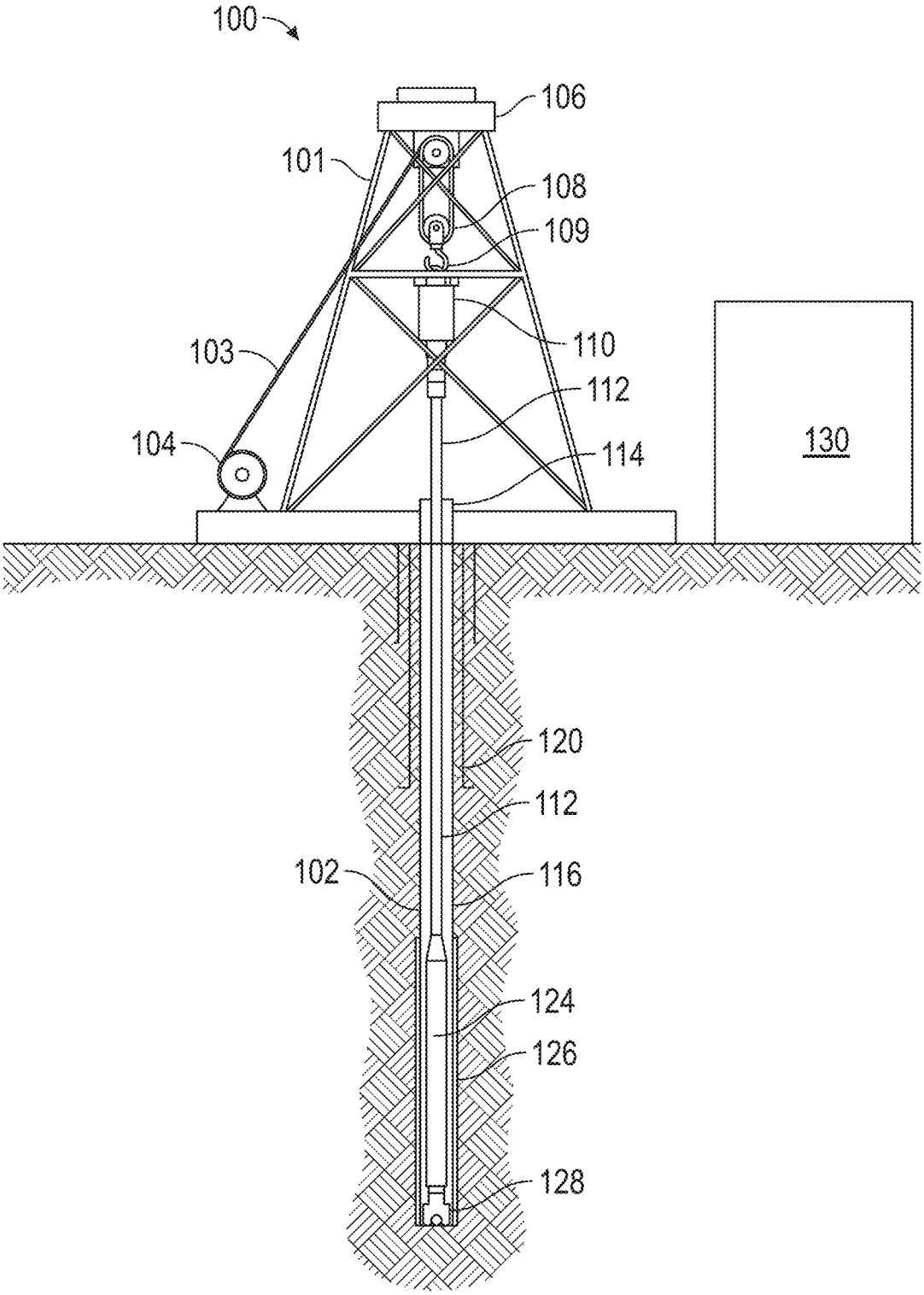
FIG. 1 schematically illustrates, in a cross-sectional elevational view, a well site with a drilling rig and wellbore in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Turning now to the figures, to facilitate easier reference when describing FIGS. 1-7, reference numerals are advanced by a multiple of 100 in indicating a similar or analogous component or element among FIGS. 1-7.

FIG. 1 schematically illustrates, in a cross-sectional elevational view, a well site with a drilling rig and wellbore by way of general background in accordance with one or more embodiments. As such, FIG. 1 illustrates a non-restrictive example of a well site 100. The well site 100 is depicted as being on land. In other examples, the well site 100 may be offshore, and drilling may be carried out with or without use of a marine riser. A drilling operation at well site 100 may include drilling a wellbore 102 into a subsurface including various formations 126. More than one wellbore 102 may be included at the well site 100, but for the present purposes of illustration only one wellbore 102 is shown. For the purpose of drilling a new section of wellbore 102, a drill string 112 is suspended within the wellbore 102. The drill string 112 may include one or more drill pipes connected to form conduit and a bottom hole assembly (BHA) 124 disposed at the distal end of the conduit. The BHA 124 may include a drill bit 128 to cut into the subsurface rock. The BHA 124 may include measurement tools, such as a measurement-while-drilling (MWD) tool or a logging-while-drilling (LWD) tool (not shown), as well as other drilling tools that are not specifically shown but would be understood to a person skilled in the art.

Additionally, the drill string 112 may be suspended in wellbore 102 by a derrick structure 101. A crown block 106 may be mounted at the top of the derrick structure 101. A traveling block 108 may hang down from the crown block 106 by means of a cable or drill line 103. One end of the drill line 103 may be connected to a drawworks 104, which is a reeling device that can be used to adjust the length of the drill line 103 so that the traveling block 108 may move up or down the derrick structure 101. The traveling block 108 may include a hook 109 on which a top drive 110 is supported. The top drive 110 is coupled to the top of the drill string 112 and is operable to rotate the drill string 112. Alternatively, the drill string 112 may be rotated by means of a rotary table (not shown) on the surface 114. Drilling fluid (commonly called mud) may be pumped from a mud system 130 into the drill string 112. The mud may flow into the drill string 112 through appropriate flow paths in the top drive 110 or through a rotary swivel, if a rotary table is used (not shown).

Further, by way of general background in accordance with one or more embodiments, and during a drilling operation at the well site 100, the drill string 112 is rotated relative to the wellbore 102 and weight is applied to the drill bit 128 to enable the drill bit 128 to break rock as the drill string 112 is rotated. In some cases, the drill bit 128 may be rotated independently with a drilling motor. Generally, it is also possible to rotate the drill bit 128 using a combination of a drilling motor and the top drive 110 (or a rotary swivel if a rotary table is used instead of a top drive) to rotate the drill string 112. While cutting rock with the drill bit 128, drilling fluid or "mud" (not shown) is pumped into the drill string 112. The mud flows down the drill string 112 and exits into the bottom of the wellbore 102 through nozzles in the drill bit 128. The mud in the wellbore 102 then flows back up to the surface 114 in an annular space between the drill string 112 and the wellbore 102 carrying entrained cuttings to the surface 114. The mud with the cuttings is returned to the mud system 130 to be circulated back again into the drill string 112. Typically, the cuttings are removed from the mud, and the mud is reconditioned as necessary, before pumping the mud again into the drill string 112.

Continuing with FIG. 1, drilling operations are completed upon the retrieval of the drill string 112, the BHA 124, and the drill bit 128 from the wellbore 102. In some embodiments of wellbore 102 construction, production casing operations may commence. A casing string 116, which is made up of one or more larger diameter tubulars that have a larger inner diameter than the drill string 112 but a smaller outer diameter than the wellbore 102, is lowered into the wellbore 102 on the drill string 112. Generally, the casing string 116 is designed to isolate the internal diameter of the wellbore 102 from the adjacent formation 126. Once the casing string 116 is in position, it is set and cement is typically pumped down through the internal space of the casing string 116, out of the bottom of the casing shoe 120, and into the annular space between the wellbore 102 and the outer diameter of the casing string 116. This secures the casing string 116 in place and creates the desired isolation between the wellbore 102 and the formation 126. At this point, drilling of the next section of the wellbore 102 may commence.

While FIG. 1 illustrates a conventional drilling process in which a casing string 116, including a production casing, may be installed subsequent to drilling, one or more embodiments as broadly contemplated herein relate to CWD processes and unique related challenges as touched on above.

Thus, by way of additional background in accordance with one or more embodiments, CWD generally permits drilling in unstable wellbore conditions that involve a potential for significant losses, and it can take different forms. Thus, "level 1" CWD involves reaming a casing into a pre-drilled hole, "level 2" involves drilling and simultaneously reaming a casing into the progressively drilled hole, but with a non-retrievable BHA. "Level 3" CWD, for its part, then involves a similar process as "level 2" CWD but involves the use of a retrievable BHA.

Thus, in accordance with one or more embodiments, broadly contemplated herein are systems and methods that permit level 3 CWD via the use of expandable packers, such as two expandable metal (e.g., steel) packers. Though a specific application of stage cementing is discussed herein, it should be understood that expandable packers as broadly described and contemplated herein can be used in essentially any application requiring a permanent packer, e.g., applications involving double annular barriers for annular isolation.

As such, in accordance with one or more embodiments, stage cementing permits the introduction of cement between a casing (e.g., production casing) and a wellbore across selected intervals. Typically, stage cementing can be facilitated via packers, "baskets", stage collars or other components sufficient for bridging the annular gap between the casing and the wellbore and provide, where needed, a barrier against the throughflow of fluids or cement. Thus, it will also be appreciated that a system of expandable packers as broadly described and contemplated herein, can provide very effective zonal isolation for stage cementing in challenging contexts such as level 3 CWD and related directional drilling.

Figure 2:
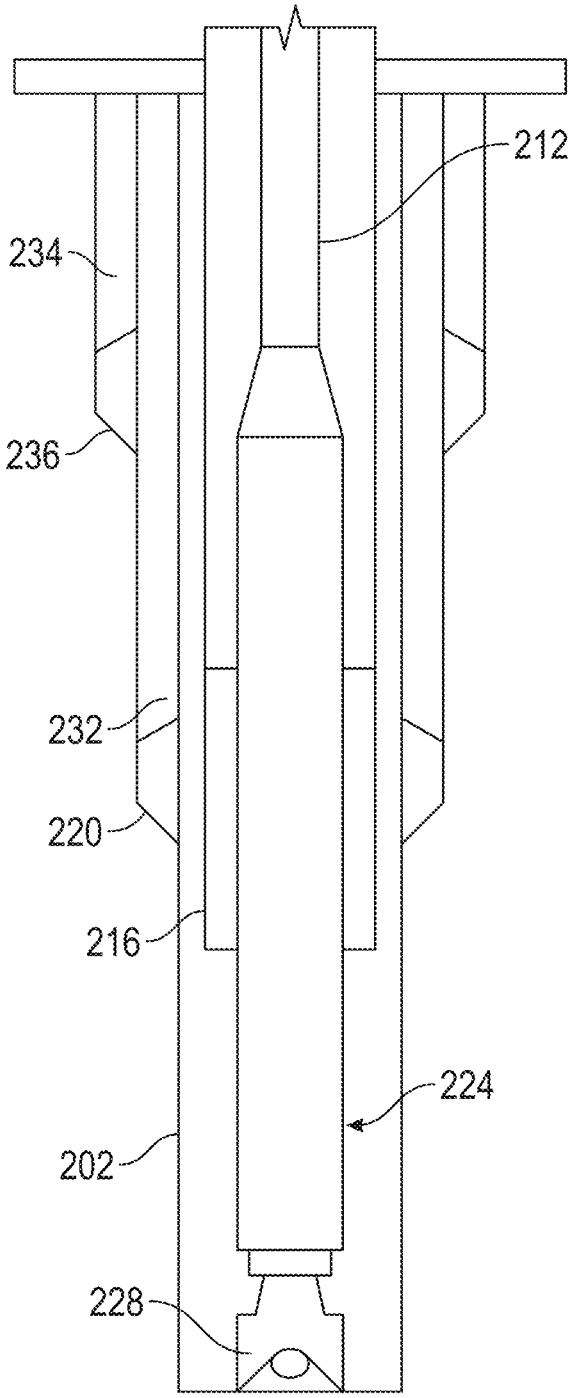
FIG. 2 schematically illustrates, in a cross-sectional elevational view, a wellbore and related components in the context of a level 3 CWD system, in accordance with one or more embodiments.

FIG. 2 schematically illustrates, in a cross-sectional elevational view, a wellbore and related components in the context of a level 3 CWD system, in accordance with one or more embodiments. As shown, drill string 212 is suspended within a progressively drilled wellbore 202 and includes, at a distal end, BHA 224 with drill bit 228.

In accordance with one or more embodiments, and in accordance with the present working example, a production casing 216 is reamed into the wellbore 202 simultaneously with the drilling operation. Other casings, previously set within the wellbore 202, include a surface casing 232 disposed adjacent to, and radially outward from, production casing 216 and may terminate downhole at casing shoe 220. Additionally, a conductor casing 234 may be disposed adjacent to, and radially outward from, surface casing 232 and may terminate downhole at casing shoe 236.

Figure 3:
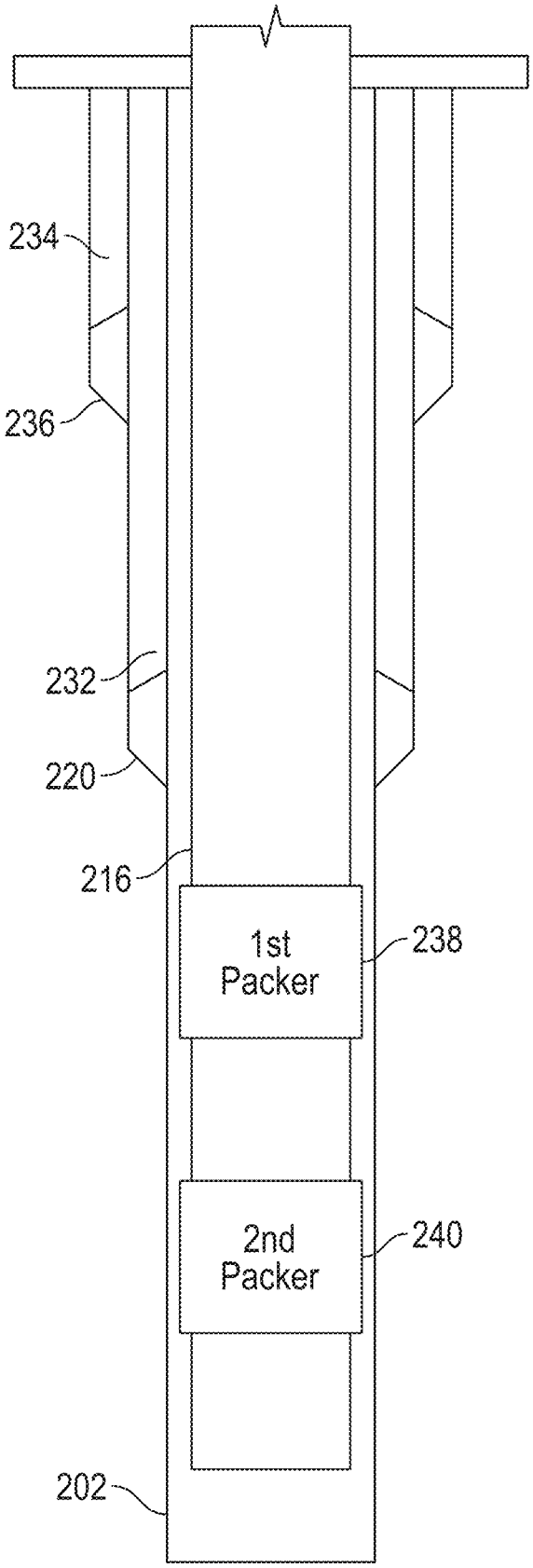
FIG. 3 provides essentially the same view as FIG. 2 but also schematically illustrates packers disposed on the production casing, in accordance with one or more embodiments.

FIG. 3 provides essentially the same view as FIG. 2 but also schematically illustrates packers disposed on the production casing 216, in accordance with one or more embodiments. Thus, a first expandable packer (or "primary packer") 238 may be disposed at a first axial position along the production casing 216 and a second expandable packer (or "secondary packer") 240 may be disposed at a second axial position along the production casing 216, spaced apart axially from the first packer 238. It should be understood as well, that the first and second packers 238, 240 may be disposed at different axial positions, in general or with respect to one another, than at the axial positions depicted in FIG. 3. Both of the first and second packers 238, 240, and particularly one or more expandable wall portions for each, may be formed from a suitable steel such as SAE 316L grade stainless steel.

In accordance with one or more embodiments, first packer 238 may take any of a great variety of forms. It may be utilized as an initial, primary measure in a stage cementing operation, for cementing the production casing 216 to interior surfaces of the wellbore 202.

In accordance with one or more embodiments, and merely by way of illustrative example, the first packer 238 may be actuated such that one or more expandable wall portions expand in a radially outward direction via a ball that displaces axially in response to applied pressure and contacts one or more components of a sliding sleeve. The sleeve is then urged to slide in an axial direction and thereby and opens a plurality of ports that permit a throughflow of fluid that compels the noted wall portions to expand. Alternatively, first packer 238 may involve a system not including a ball and sliding sleeve, and instead may include a plurality of ports of sufficient size and distribution that permit the throughflow of fluid. Thus, responsive to a predetermined threshold pressure created by sufficient fluid flow, one or more expandable wall portions will then expand in a radially outward direction.

At the same time, in accordance with one or more embodiments, second packer 240 may be provided at the very least as a "backup" mechanism in a stage cementing process, in the event that the first packer 238 fails to properly operate or deploy. Via such a measure, and via the second packer 240, the annulus between the production casing 216 and wellbore 202 may then be bridged sufficiently as to permit the more effective execution of a stage cementing process.

In accordance with one or more embodiments, the second packer 240 may be actuated via a chemical powder that is ignited via one or more different triggers, responsive to a higher threshold pressure than that which is needed to actuate the first packer 238. Thus, while the first packer 238 includes one or more expandable wall portions that expand in response to a first threshold pressure, the second packer 240 includes one or more expandable wall portions that expand in response to a second threshold pressure that is higher than the first threshold pressure.

Figure 4:
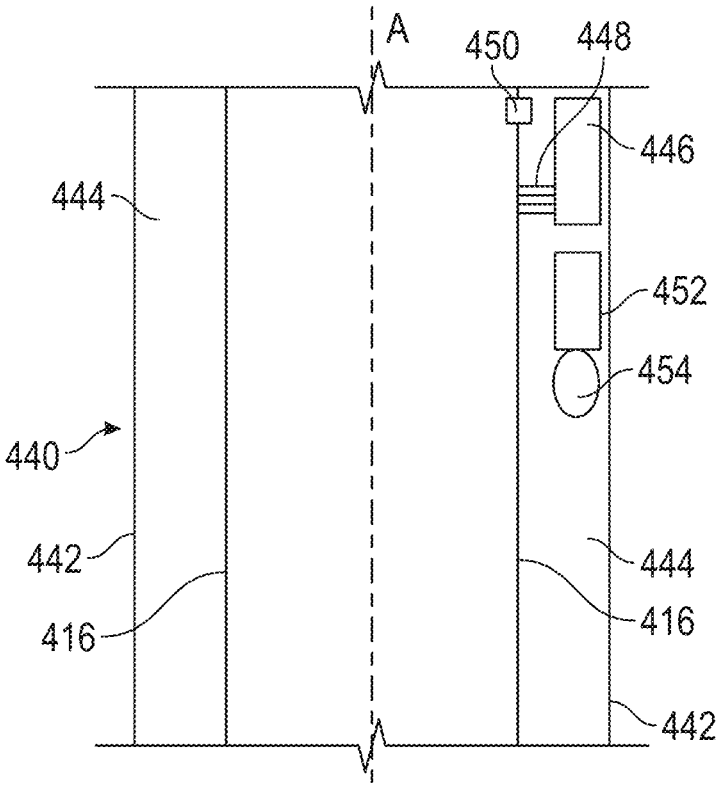
FIG. 4 schematically illustrates, in a cross-sectional elevational view, a secondary expandable packer and related components in an initial rest configuration, in accordance with one or more embodiments.

FIG. 4 schematically illustrates, in a cross-sectional elevational view, components of a secondary expandable packer 440 (or "second packer") and related components in an initial rest configuration, in accordance with one or more embodiments. As shown, second packer 440 may be disposed at a generally cylindrical external surface of production casing 416. Second packer 440 may be defined by one or more outer expandable wall portions 442 (e.g., a single outer wall portion that is generally cylindrical in configuration) configured to expand or deploy in a radially outward direction, away from a central longitudinal axis A.

In accordance with one or more embodiments, in an annular space 444 defined between an outer surface of the production casing 416 and the one or more outer expandable wall portions 442, an axially movable component 446 may be mounted and held in a rest position as shown via one or more shear pins 448. Additionally, a check valve 450 may be provided in a wall of the production casing 416 to provide fluid communication between an interior of production casing 416 and the annular space 444. The check valve 450, as such, is configured to permit solely one-way fluid flow in a radially outward direction above the noted second threshold pressure. Also provided is an ignition component 452, that is mounted at an axially spaced-apart position with respect to the rest position of axially movable component 446. Additionally, a small store of explosive chemical powder 454 is provided adjacent to the ignition component 452.

In accordance with one or more embodiments, in response to the fluid flow into annular space 444 and concomitant increase in pressure as governed by check valve 450, axially movable component 446 is urged to displace in an axial direction (e.g., in a downhole direction) and shear pins 448 are broken to permit such continued axial displacement.

Figure 5:
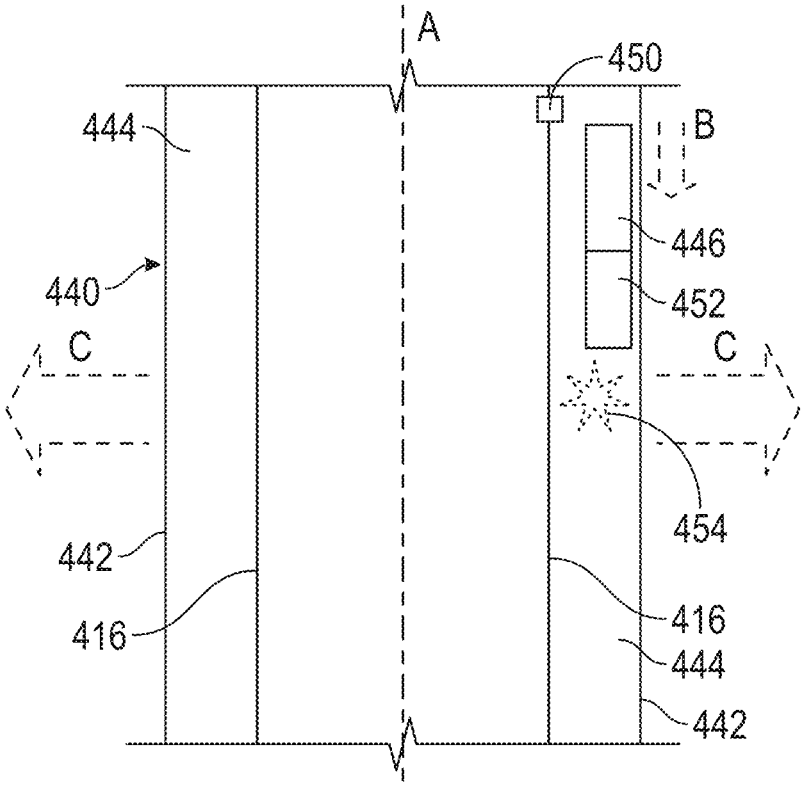
FIG. 5 provides essentially the same view as FIG. 4 but shows the secondary expandable packer and related components in an active configuration, in accordance with one or more embodiments.

FIG. 5 provides essentially the same view as FIG. 4 but shows the second packer 440 and related components in an active configuration, in accordance with one or more embodiments. Thus, with the shear pins 448 shown in FIG. 4 now broken, axially movable component 446 now displaces in an axial direction (indicated by arrow B) and engage in physical and/or functional contact with ignition component 452. The ignition component 452 is thereby triggered to cause the powder 454 to explode and thereby urge the one or more outer expandable wall portions 442 to deploy or expand in a radially outward direction as indicated by arrows C.

In accordance with one or more embodiments, the axially movable component 446 shown in FIGS. 4 and 5 may be embodied by a spring-loaded piston that is urged to continue to displace in the axial direction B when the shear pins 448 are broken. In accordance with this working example, the ignition component 452 may then be embodied by a firing head that, responsive to physical perturbation via direct physical contact from the spring-loaded piston or a component thereof, produces a spark sufficient for burning the chemical powder 454 and causing the same to explode. By way of merely illustrative example, such a firing head may be similar or analogous to those used in wireline-conveyed casing perforation guns. Additionally, the spring-loaded piston embodying component 446 may include an elongated, needle-like portion integral with or attached to a main body portion, and that contacts a portion of the ignition component 452 to activate the same in a manner to produce a spark sufficient for burning the chemical powder 454 and causing the same to explode.

By way of another working example in accordance with one or more embodiments, the axially movable component 446 shown in FIGS. 4 and 5 may be embodied by a battery, that itself may be spring-loaded or pre-biased in another manner, that is urged to continue to continue to displace in the axial direction B when the shear pins 448 are broken. In accordance with this working example, the ignition component 452 may then be embodied by an igniter that, responsive to physical contact from the battery, is activated via completion of an electrical circuit to thereby produce a spark sufficient for burning the chemical powder 454 and causing the same to explode. For instance, the ignition component 452, or igniter, may be embodied by an electrical firing head that is activated via simple physical contact by the battery embodying component 446.

In accordance with one or more embodiments, the individual components shown in annular space 444 of second packer 440 may be disposed and dimensioned essentially in any suitable manner to perform the functions described herein. Thus, the check valve 450 and spring-loaded piston or battery 446 may be embodied by essentially any suitable components that can carry out their described functions, while being appropriately dimensioned so as to be compatible with existing dimensions of the casing 416 (e.g., its inner and outer diameters) and of the annular space 444. Chemical powder 454, for its part, may be embodied by essentially any powder that can produce a sufficient force for expanding the outer expandable wall portions, e.g., on an order of magnitude of up to 50,000 psi (pounds per square inch).

Figure 6:
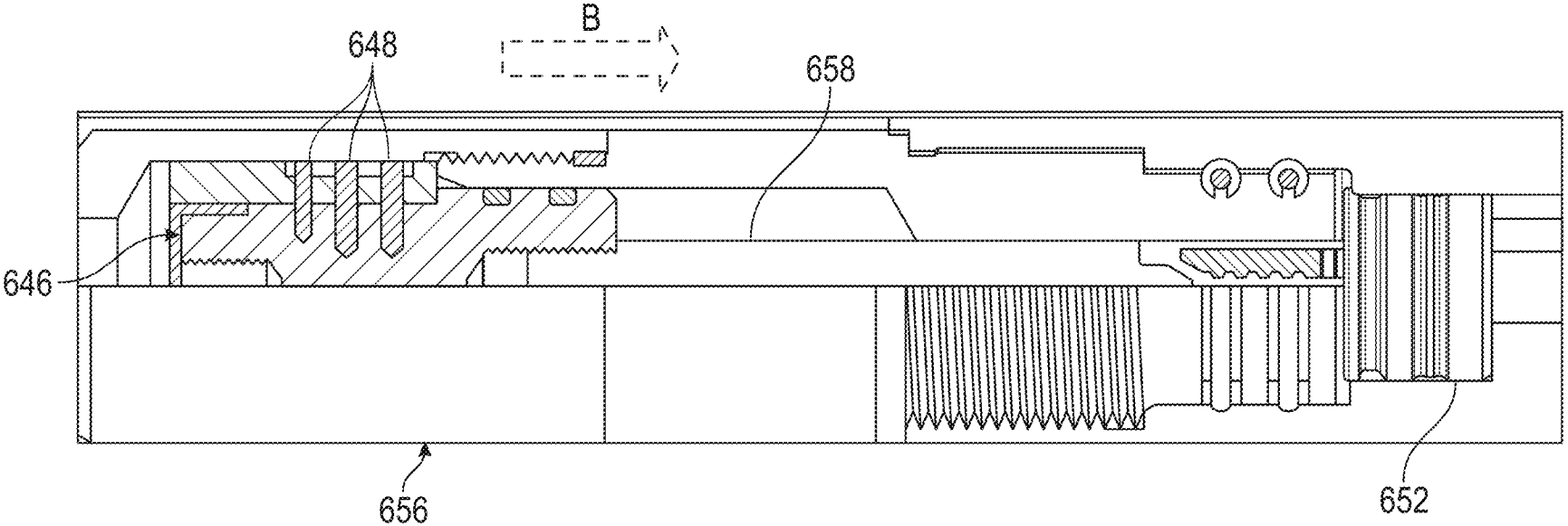
FIG. 6 is illustrates, in a partial cross-sectional elevational view, an example of a self-contained igniting unit in accordance with one or more embodiments.

FIG. 6 illustrates, in a partial cross-sectional elevational view, an example of a self-contained igniting unit 656 in accordance with one or more embodiments. Thus the igniting unit 656, provided merely as a non-restrictive illustrative working example, may include both a spring-loaded piston 646 as initially described above as well as an ignition component 652. The unit 656 may be mounted in an annular space (such as that indicated at 444 in FIGS. 4 and 5), with the spring-loaded piston 646 initially be held in place via shear pins 448.

In accordance with one or more embodiments, in response to a sufficient increase in pressure, spring-loaded piston 646 is urged to displace in axial direction B with sufficient force as to break shear pins 648 are broken to initiate, and then continue, such axial displacement. In accordance with the present working example, an elongated or needle-like firing pin 658 is provided that extends axially as a constituent portion of piston 646 (e.g., from a main body portion of the piston 646 as shown), and ignition component 652 is embodied as a percussion initiator. With the piston 646 displacing in axial direction B, the firing pin 658 likewise displaces and then contacts percussion initiator 652 with sufficient force as to produce a spark sufficient for burning a chemical powder (such as that indicated at 454 in FIGS. 4 and 5) and causing the same to explode.

In accordance with one or more variant embodiments, a secondary packer 440 such as that described and illustrated with respect to FIGS. 4 and 5 may constitute a portion of a system that employs only a single expandable packer. Thus, in such a scenario, the expandable wall portions 442 may expand in response to a threshold pressure that is greater than a predetermined maximum drilling pressure, such that they do not expand prematurely while drilling is taking place.

In accordance with one or more variant embodiments, a secondary packer 440, such as that described and illustrated with respect to FIGS. 4 and 5, may be configured to incorporate its own provision for backup. This backup provision may apply whether the secondary packer 440 is part of a system that employs a single expandable packer or two expandable packers. Thus, in such a scenario, if the ignition component 452 fails to ignite the chemical powder 454, then pressure within the casing 416 may be increased to a higher pressure than the noted second threshold pressure, wherein the higher pressure is sufficient to cause expansion of the expandable wall portions 442 by way of continued fluid flow through the check valve 450.

By way of advantages that may be appreciated in accordance with one or more embodiments, expandable packers such as those broadly described and contemplated herein can greatly facilitate directional drilling in the context of level 3 CWD in challenging stratigraphic conditions (especially as initially noted). For instance, a greatly stabilized casing can be facilitated, that can run over great a length within a wellbore, while allowing deep directional drilling via a BHA that itself can then be easily retrieved.

Additionally, in accordance with one or more embodiments, expandable packers as broadly described and contemplated can be used a great variety of applications beyond those specifically set forth. Generally, with associated high pressure and high temperature resistance properties, they can meet various specific expectations that easily elude conventional inflatable or swellable packers cannot meet, and can meet a great variety of challenges encountered in high pressure hydraulic fracturing and various operational challenges often encountered in CWD. In addition, if formed from a stronger, more durable steel such as SAE 316L grade stainless steel, then they can particularly help ensure annular integrity over the longer term and thereby help prevent uncontrolled fluid and gas migrations into the casing-wellbore annulus.

Figure 7:
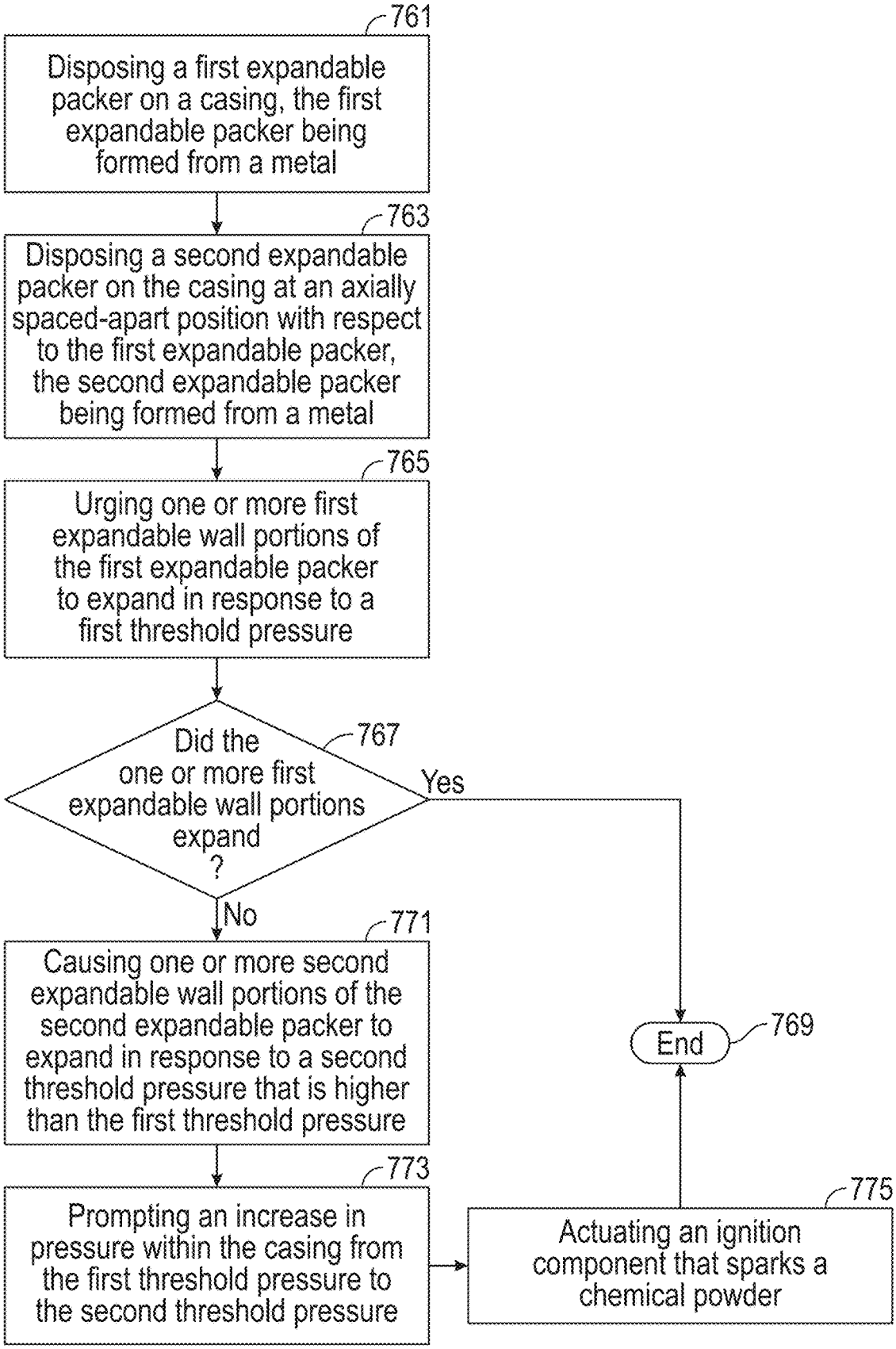
FIG. 7 shows a flowchart of a method, in accordance with one or more embodiments.

FIG. 7 shows a flowchart of a method, as a general overview of steps which may be carried out in accordance with one or more embodiments described or contemplated herein. Specifically, FIG. 7 describes a method of utilizing a packer system. One or more blocks in FIG. 7 may be performed using one or more components as described in FIGS. 1-6. While the various blocks in FIG. 7 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

As such, in accordance with one or more embodiments, a first expandable packer is disposed on a casing (Block 761). The first expandable packer is formed from a metal. Next, a second expandable packer is disposed on the casing at an axially spaced-apart position with respect to the first expandable packer (Block 763). The second expandable packer is also formed from a metal and may or may not be the same metal that forms the first expandable packer. By way of illustrative example, these may correspond to the first and second packers 238, 240 described and illustrated with respect to FIG. 3.

In accordance with one or more embodiments, one or more first expandable wall portions of the first expandable packer are triggered to expand in response to a first threshold pressure (Block 765). At this stage, a determination is made in Block 767. If the one or more first expandable wall portions expand (YES), then these process steps effectively end (Block 769). If the expansion of the first expandable packer is unsuccessful (Block 767; NO), one or more second expandable wall portions of the second expandable packer are actuated to expand in response to a second threshold pressure that is higher than the first threshold pressure (Block 771). In one or more embodiments, causing the one or more second expandable wall portions to expand includes prompting an increase in pressure within the casing from the first threshold pressure to the second threshold pressure (Block 773) and actuating an ignition component that sparks a chemical powder (Block 775). More specifically, in one or more embodiments, a spark burns the powder to ignite the ignition component via a pre-loaded spring piston along with firing head. In order to activate the ignitor, a pressure is applied to break the shear pins and set the piston free. The piston moves down trigging the firing head to fire. In another example, the chemical powder may be ignited using a battery system along with an ignitor which can create the required spark to burn the powder. The battery is similarly spaced out from the ignitor and fixed in place using shear pins. In order to activate the ignitor, a pressure is applied to break the shear pins and push the battery down, thereby completing the electrical circuit and in return activating the ignitor.

Thus, the second expandable packer is a fail-safe or back up to the first expandable packer, and is ignited using unique means when the first packer walls fail to expand sufficiently or correctly. By way of illustrative example, these steps may be appreciated in connection with the examples described and illustrated with respect to FIGS. 3, 4 and 5.

Embodiments disclosed herein describe a method and system for upgraded DV-Cementing Stage for a Directional Casing Drilling Retrievable System that enables casing while drilling level 3 by utilizing dual expandable steel packers. The two packers may be employed in any application requiring a permanent packer (double annular barriers for annular isolation). With their unique high pressure and high temperature resistance properties, the packers disclosed herein can meet various specific expectations that classic inflatable or swellable packers cannot meet. It is applicable for high pressure hydraulic fracturing and other drilling challenges specially during well casing.

In addition, the packers provide a reliable life-of-the-well annular barrier since they are made of stainless steel (e.g., S316L). Annular integrity is a growing concern and the dual packer disclosed herein provides a long-term solution to prevent uncontrolled fluid and gas migrations in the annulus.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

What is claimed:

1. A packer system comprising:

an expandable packer disposed on a casing, wherein the expandable packer:

is formed from a metal;

includes one or more expandable wall portions that expand in response to a threshold pressure that is greater than a predetermined maximum drilling pressure; and includes an ignition component that sparks a chemical powder to cause the one or more expandable wall portions to expand, wherein the expandable packer is a second expandable packer comprising:

an axially movable component, and one or more shear pins that hold the axially movable component in a rest position, wherein the ignition component is mounted at an axially spaced-apart position with respect to the rest position of the axially movable component, and wherein the chemical powder is disposed adjacent to the ignition component.

2. The packer system according to claim 1, wherein:

the one or more expandable wall portions are second expandable wall portions, and the threshold pressure is a second threshold pressure;

said packer system further comprising a first expandable packer disposed on the casing at an axially spaced-apart position with respect to the second expandable packer;

the first expandable packer being formed from a metal; and the first expandable packer including one or more first expandable wall portions that expand in response to a first threshold pressure that is lower than the second threshold pressure.

3. The packer system according to claim 2, wherein:

the second expandable packer includes a check valve that provides fluid communication between an interior of the casing and an annular space defined between an outer surface of the casing and the one or more second expandable wall portions;

the check valve being configured to permit solely one-way fluid flow in a radially outward direction from the interior of the casing in response to the second threshold pressure.

4. The packer system according to claim 3, wherein the casing is a production casing.

5. The packer system according to claim 4, wherein the first expandable wall portions and the second expandable wall portions are formed from steel.

6. The packer system according to claim 4, wherein in response to fluid flow through the check valve, the axially movable component is urged to displace in an axial direction and break the shear pins.

7. The packer system according to claim 6, wherein in response to breaking of the shear pins:

the axially movable component displaces in an axial direction toward the ignition component; and the ignition component is triggered to cause the chemical powder to explode and cause the one or more second expandable wall portions to expand.

8. The packer system according to claim 7, wherein:

the axially movable component comprises a spring-loaded piston; and the ignition component comprises a firing head.

9. The packer system according to claim 8, wherein:

the second expandable packer includes an igniting unit; and the igniting unit includes the spring-loaded piston and the firing head.

10. The packer system according to claim 9, wherein:

the spring-loaded piston includes a firing pin extending axially from a main body portion of the spring-loaded piston; and the firing head comprises a percussion initiator.

11. The packer system according to claim 7, wherein:

the axially movable component comprises a battery; and the ignition component comprises an igniter.

12. The packer system according to claim 11, wherein the igniter, responsive to physical contact from the battery, is activated via completion of an electrical circuit and produces a spark sufficient for burning the chemical powder.

13. A method comprising:

disposing a first expandable packer on a casing, the first expandable packer being formed from a metal;

disposing a second expandable packer on the casing at an axially spaced-apart position with respect to the first expandable packer, the second expandable packer being formed from a metal;

urging one or more first expandable wall portions of the first expandable packer to expand in response to a first threshold pressure within the casing;

determining whether the one or more first expandable wall portions expanded in response to the first threshold pressure; and when the one or more first expandable wall portions do not expand in response to the first threshold pressure:

causing one or more second expandable wall portions of the second expandable packer to expand in response to a second threshold pressure within the casing that is higher than the first threshold pressure, wherein causing the one or more second expandable wall portions to expand comprises:

prompting an increase in pressure within the casing from the first threshold pressure to the second threshold pressure; and actuating an ignition component that sparks a chemical powder, wherein the first expandable wall portions and the second expandable wall portions are formed from SAE 316L grade stainless steel.

14. The method according to claim 13, further comprising:

disposing, in the second expandable packer, a check valve that provides fluid communication between an interior of the casing and an annular space defined between an outer surface of the casing and the one or more second expandable wall portions; and via the check valve, permitting solely one-way fluid flow in a radially outward direction from the interior of the casing in response to the second threshold pressure.

15. The method according to claim 14, further comprising deploying the casing into a wellbore via a level 3 casing-while-drilling (CWD) process.

16. The method according to claim 15, further comprising:

disposing an axially movable component in the second expandable packer; and holding the axially movable component in a rest position via one or more shear pins.

17. The method according to claim 16, further comprising:

mounting the ignition component at an axially spaced-apart position with respect to the rest position of the axially movable component;

displacing the axially movable component in an axial direction in response fluid flow through the check valve, thereby breaking the shear pins; and in response to breaking the shear pins:

further displacing the axially movable component toward the ignition component; and triggering the ignition component to cause the chemical powder to explode and cause the one or more second expandable wall portions to expand.

* * * * *